US006259365B1

(12) United States Patent
Hagar et al.

(10) Patent No.: US 6,259,365 B1
(45) Date of Patent: Jul. 10, 2001

(54) LASER SECURITY FENCE APPARATUS

(76) Inventors: James Hagar, 4014 Saratoga Dr., Janesville, WI (US) 53546; Richard A. Kirchner, 615 Johnson St., Janesville, WI (US) 53545

( * ) Notice: Subject to any disclaimer, the term of this patent is extended or adjusted under 35 U.S.C. 154(b) by 0 days.

(21) Appl. No.: 09/506,345

(22) Filed: Feb. 17, 2000

(51) Int. Cl.[7] ..... G08B 13/18

(52) U.S. Cl. ..... 340/557; 340/541; 340/545.3; 340/556; 367/118

(58) Field of Search ..... 340/556, 557, 340/555, 541, 545.3; 367/118

(56) References Cited

U.S. PATENT DOCUMENTS

| | | | | |
|---|---|---|---|---|
| 3,623,057 | * | 11/1971 | Hedin | 340/258 B |
| 3,688,298 | * | 8/1972 | Miller et al. | 340/258 B |
| 3,704,461 | * | 11/1972 | Rose et al. | 340/258 B |
| 3,711,846 | * | 1/1973 | Schlisser et al. | 340/258 B |
| 4,910,498 | * | 3/1990 | Feher | 340/556 |
| 5,063,288 | * | 11/1991 | Hsu et al. | 250/221 |
| 5,195,060 | * | 3/1993 | Roll | 367/118 |
| 5,223,817 | * | 6/1993 | Hoyle | 340/554 |

OTHER PUBLICATIONS

Prevent TM Laser Perimeter Pool Alarm.

* cited by examiner

*Primary Examiner*—Daniel J. Wu
*Assistant Examiner*—Phung Nguyen
(74) *Attorney, Agent, or Firm*—David J. Archer

(57) ABSTRACT

A laser security fence apparatus is disclosed for providing a warning signal in response to an intrusion by an intruder of a restricted area. The apparatus includes a laser generator for generating a laser beam and a first mirror aligned with the laser beam for reflecting the beam. A second mirror is aligned with the first mirror for reflecting the beam reflected by the first mirror and a collector is aligned with the second mirror for collecting the beam reflected by the second mirror. A microprocessor is associated with the collector and the generator for sensing when the beam is broken by the intruder so that the beam is not received by the collector. An alarm is connected to the microprocessor for actuation by the microprocessor when the microprocessor senses that the beam is broken so that the alarm provides the warning signal.

1 Claim, 9 Drawing Sheets

Fig. 5.
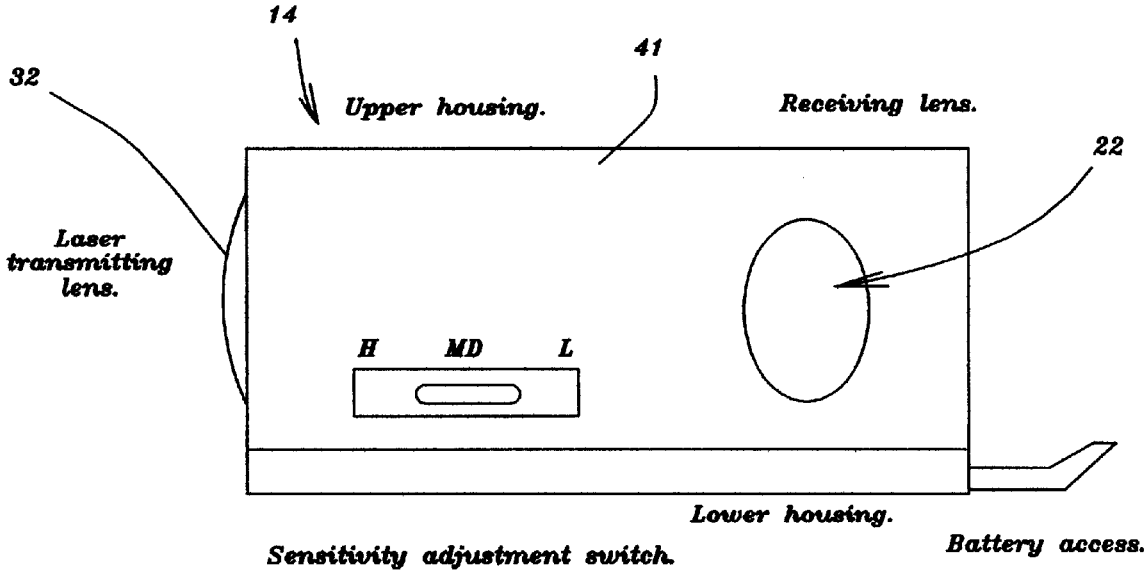
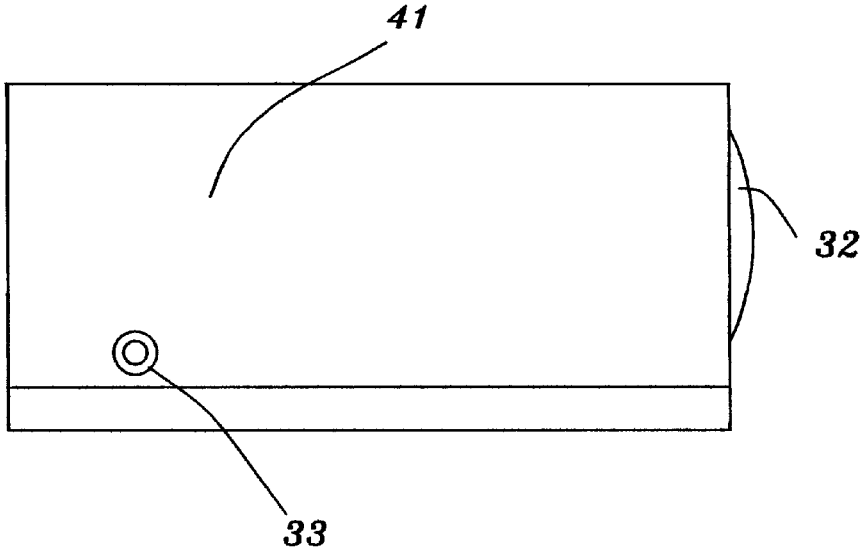
Fig. 5a

LASER SECURITY FENCE APPARATUS

BACKGROUND OF THE INVENTION

1. Field of the Invention

The present invention relates to a laser security fence apparatus. More specifically, the present invention relates to a laser security fence apparatus for providing a warning signal in response to an intrusion by an intruder of a restricted area.

2. Background Information

Each year many fatal accidents occur due to children drowning after entering unattended into pool areas. Although several fence arrangements have been proposed for restricting access to a pool area, there is always a possibility that a gate may be left unlocked so that a child or toddler can enter the pool area and fall into the pool without the parents being aware of the situation.

Furthermore, traditional fences and gates usually detract from the aesthetics of the pool and surrounding pool area. The present invention provides a laser fence apparatus that immediately alerts the pool owner that someone has entered the restricted area. In this way, if a toddler or baby crawls past the laser fence, the parents are immediately alerted about the potential danger before the child is able to reach the actual pool.

Therefore, it is a primary feature of the present invention to provide a laser security fence apparatus that overcomes the problems associated with the prior art fence arrangements and which provides a significant contribution to the art of pool safety.

Another feature of the present invention is the provision of a laser security fence for surrounding any restricted area such as a camp ground or the like.

Other features and advantages of the laser security fence apparatus according to the present invention will be readily apparent to those skilled in the art by a consideration of the detailed description contained herein of a preferred embodiment of the present invention.

SUMMARY OF THE INVENTION

The present invention relates to a laser security fence apparatus for providing a warning signal in response to an intrusion by an intruder of a restricted area. The apparatus includes a laser generator for generating a laser beam and a first mirror aligned with the laser beam for reflecting the beam. A second mirror is aligned with the first mirror for reflecting the beam reflected by the first mirror and a collector is aligned with the second mirror for collecting the beam reflected by the second mirror. A microprocessor is associated with the collector and the generator for sensing when the beam is broken by the intruder, that is when the beam is not received by the collector. An alarm is connected to the microprocessor for actuation by the microprocessor when the microprocessor senses that the beam is broken so that the alarm provides the warning signal.

In a more specific embodiment of the present invention, the laser generator includes a 9 volt D.C. source of electrical energy and the laser generator is a laser diode light.

The laser generator also includes a focal lens for focusing the laser beam, the focal lens including a capacitor for adjusting a sensitivity and intensity of the beam. More particularly, the capacitor is a variable capacitor.

Moreover, the first mirror is a plane mirror, the first mirror being set angularly relative to the beam. The second mirror is also a plane mirror which is disposed angularly relative to the first mirror. The first and second mirrors are spaced relative to each other so that the beam travelling between the mirrors can travel a distance of over 100 yards.

Also, the collector includes a collecting lens for collecting the beam and an electronic circuit for generating an electrical signal in response to the beam received by the collecting lens. A transmitter is used for transmitting the electrical signal from the microprocessor. The transmitter is a radio transmitter for transmitting a R.F. wave from the microprocessor, the microprocessor being disposed in the vicinity of the collector. The R.F. waves are received by a device located inside the house for providing an audible warning that the laser beam has been broken.

Preferably, the apparatus is a security fence placed around a swimming pool to provide a warning if a child enters a pool area which would present a potentially life threatening situation for the child if the child were to enter into the pool.

Many variations and modifications of the present invention will be readily apparent to those skilled in the art by a careful consideration of the detailed description of a preferred embodiment of the present invention contained herein in conjunction with the annexed drawings. However, such modifications and variations fall within the spirit and scope of the present invention as defined by the appended claims.

Included in such modifications would be the provision of means for switching on a lighting system when the alarm signal is given so that for example, in the use of the laser fence around a pool area, when the potential danger of an intruder is sensed, the lights are switched on thus facilitating a rescue from the pool in the event of a child having fallen into the pool.

Also, the present invention envisages not only a waning speaker disposed adjacent to the collector for providing a warning in the pool area itself but also means for transmitting to a remote receiver so that a person disposed remote from the pool is alerted to the potential problem of an intruder.

Additionally, the apparatus according to the present invention is able to be energized from a D.C. source or from the mains supply via a voltage drop A C./D.C. transformer or the like.

Furthermore, the apparatus may include a timer device for allowing the laser fence to be reset automatically after the warning alarm has been activated. More specifically, the alarm can be set to sound for 30–60 seconds thus not allowing the battery power on the laser unit to be drained for an extended period of time. The delay device could include two buttons. The first button would control the wireless delay switch. When activated by depressing the first button, a signal is sent to the laser unit thus allowing the owner to pass without setting off the alarm. Subsequently, the unit would be automatically re-set to turn itself back on.

A second button is an on/off button on the portable remote receiver alarm. The second button would control the on/off switch remotely without having to leave the house or car to physically go to the laser unit to turn the unit on.

The present invention can also be used to secure a hunting camp, a car port, a fence line, an interior or exterior of a home, for securing a store, child care facility or an R.V. The present invention could also be used to warn of the intrusion of a cat within a babies crib or to warn a parent about a sleep walker.

BRIEF DESCRIPTION OF THE DRAWINGS

FIG. 5 is a side elevational view of the generator and collector shown in FIG. 1

FIG. 5*a* is a side elevational view of the generator and collector shown in FIG. 1 but viewed from the opposite side thereof;

Similar reference characters refer to similar parts throughout the various views of the drawings.

DETAILED DESCRIPTION OF THE DRAWINGS

Figure 1:
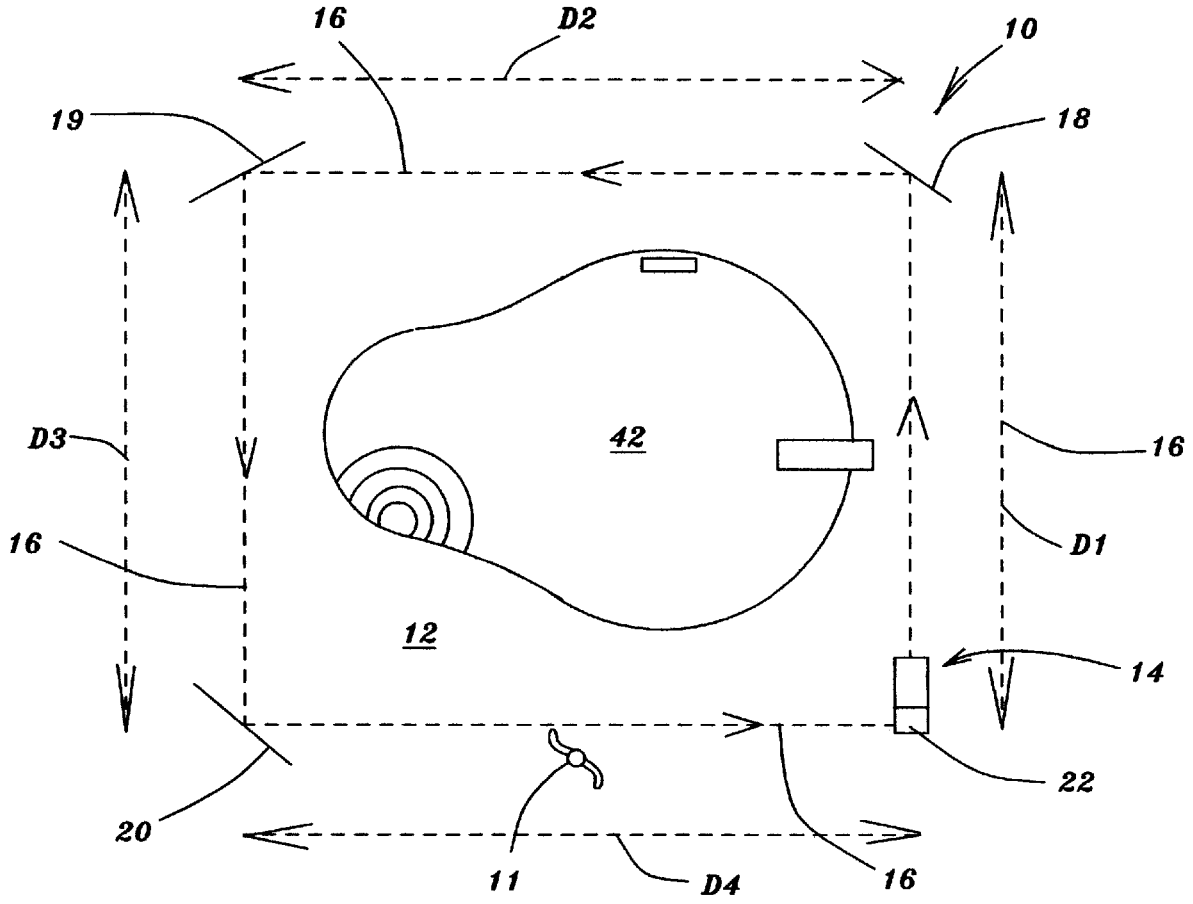
FIG. 1 is a top plan view of a laser security fence apparatus according to the present invention surrounding a swimming pool.

FIG. 1 is a top plan view of a laser security fence apparatus generally designated 10 according to the present invention for providing a warning signal in response to an intrusion by an intruder 11 of a restricted area 12.

As shown in FIG. 1, a laser generator generally designated 14 generates a laser beam 16 and a first mirror 18 aligned with the laser beam 16 reflects the beam 16. A second mirror 20 is aligned with the first mirror 18 for reflecting the beam 16 reflected by the first mirror 18. Several other mirrors such as 19 may be used if necessary to enclose and secure the restricted area 12. Furthermore, a collector 22 is aligned with the second mirror 20 for collecting the beam 16 reflected by the second mirror 20.

Figure 2:
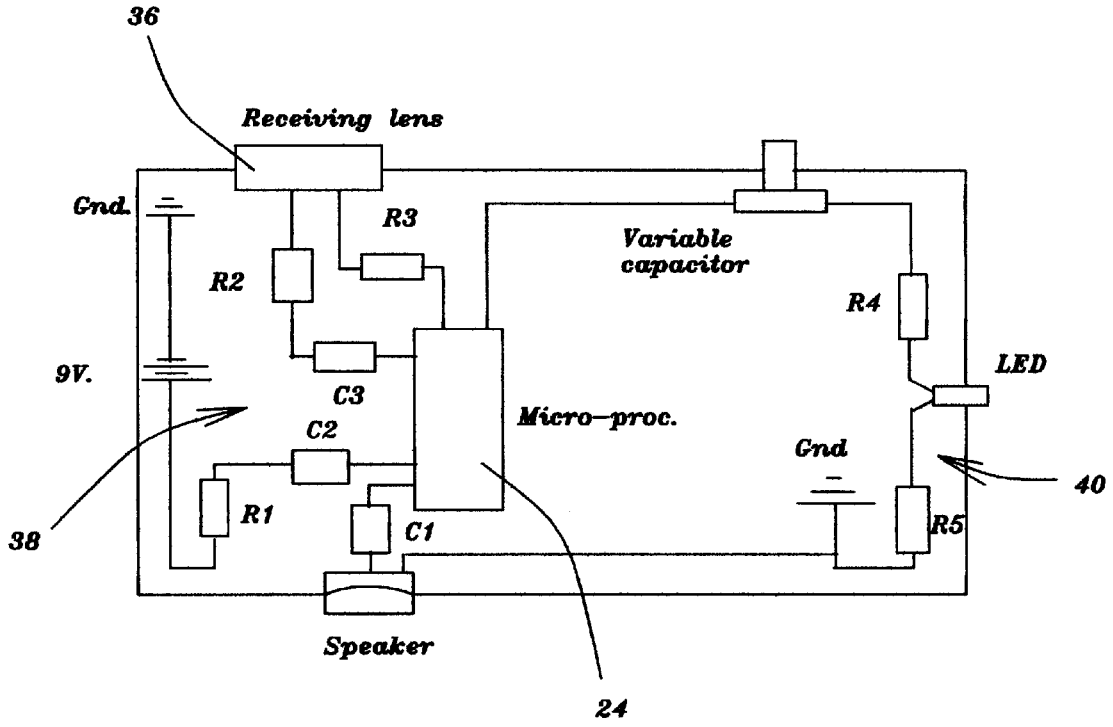
FIG. 2 is a circuit diagram showing details of the apparatus shown in FIG. 1

FIG. 2 is a circuit diagram showing details of the apparatus shown in FIG. 1. As shown in FIG. 2, the apparatus 10 includes a microprocessor 24 which is associated with the collector 22 and the generator 14 for sensing when the beam 16 is broken by the intruder 11 so that the beam 16 is not received by the collector 22.

Figure 3:
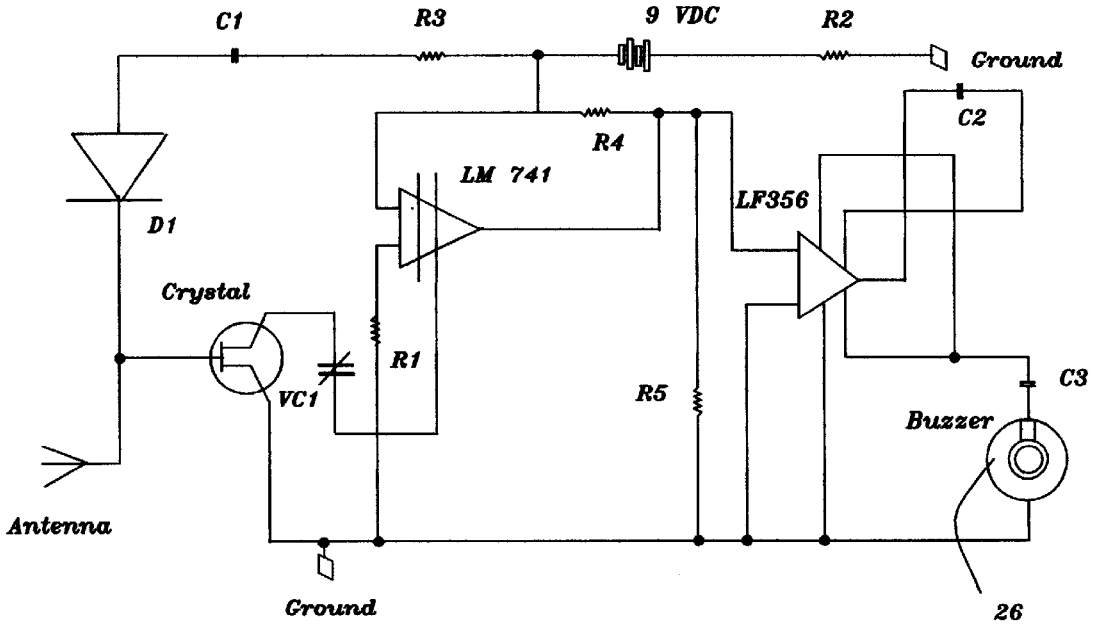
FIG. 3 is a circuit diagram showing further details of the apparatus shown in FIG. 1.

FIG. 3 is a circuit diagram showing further details of the apparatus shown in FIG. 1. As shown in FIG. 3, an alarm 26 is connected by R.F. frequency waves to the microprocessor 24 so that the alarm 26 such as a buzzer is actuated remotely by the microprocessor 24 when the microprocessor 24 senses that the beam 16 is broken so that the alarm 26 provides the warning signal.

Figure 4:
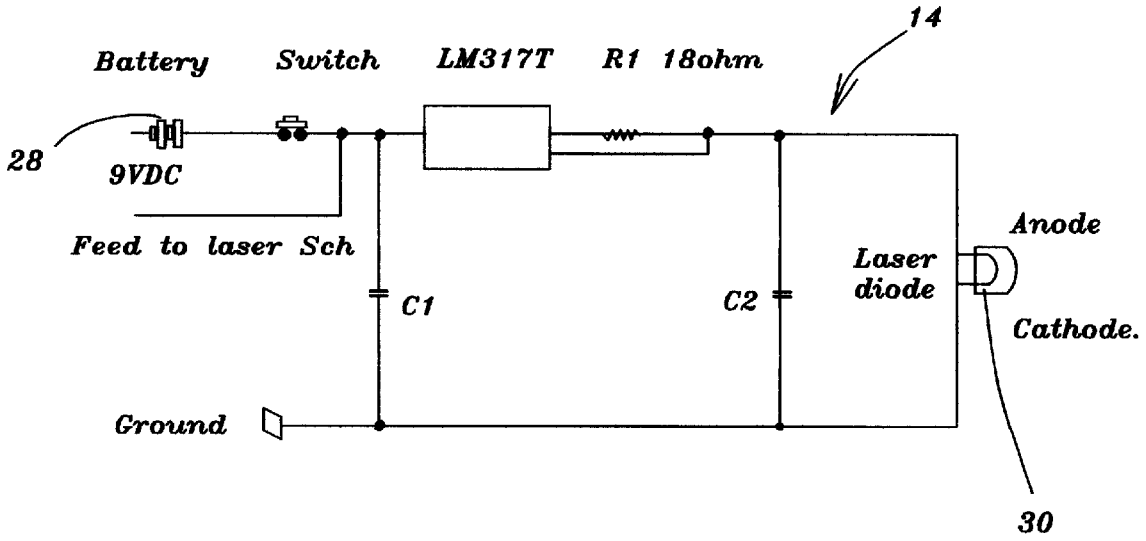
FIG. 4 is a circuit diagram showing details of the laser generator for the apparatus shown in FIG. 1.

FIG. 4 is a circuit diagram showing details of the laser generator 14 for the apparatus 10 shown in FIG. 1. As shown in FIG. 4, the laser generator 14 includes a 9 volt D.C. source of electrical energy 28 and the laser generator 14 includes a laser diode light 30.

FIG. 5 is a side elevational view of the generator 14 and collector 22 shown in FIG. 1. As shown in FIG. 5, the laser generator 14 also includes a focal lens 32 for focusing the laser beam 16.

FIG. 5*a* is a similar view to that shown in FIG. 5 but shows the opposite side of the generator and collector. FIG. 5*a* shows an external power jack plug 33.

Figure 5B:
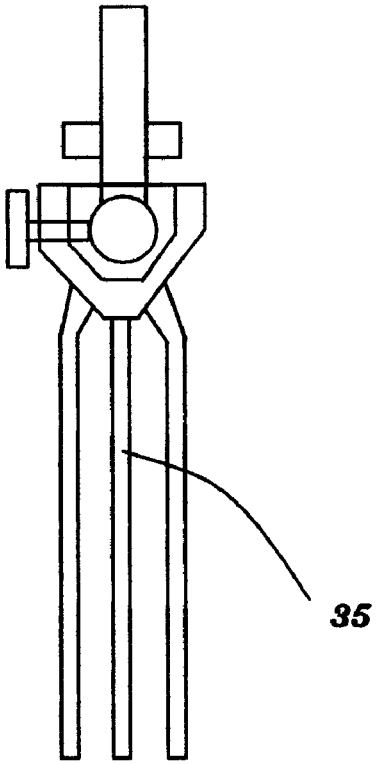
FIG. 5*b* is a side elevational view of a tripod used for supporting the generator and colletor shown in FIG. 1.

FIG. 5*b* is a side elevational view of a tripod 35 used for supporting the generator14 and colletor 22. However, the generator 14 and collector could be secured by screws to a wall or the like.

Figure 5C:
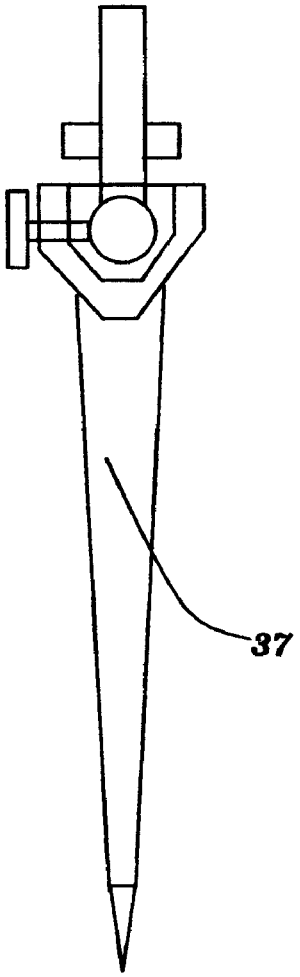
FIG. 5*c* is a side elevational view of a spike used for supporting each of the mirrors shown in FIG. 1.

FIG. 5*c* is a side elevational view of a spike 37 used for supporting each of the mirrors.

Figure 6:
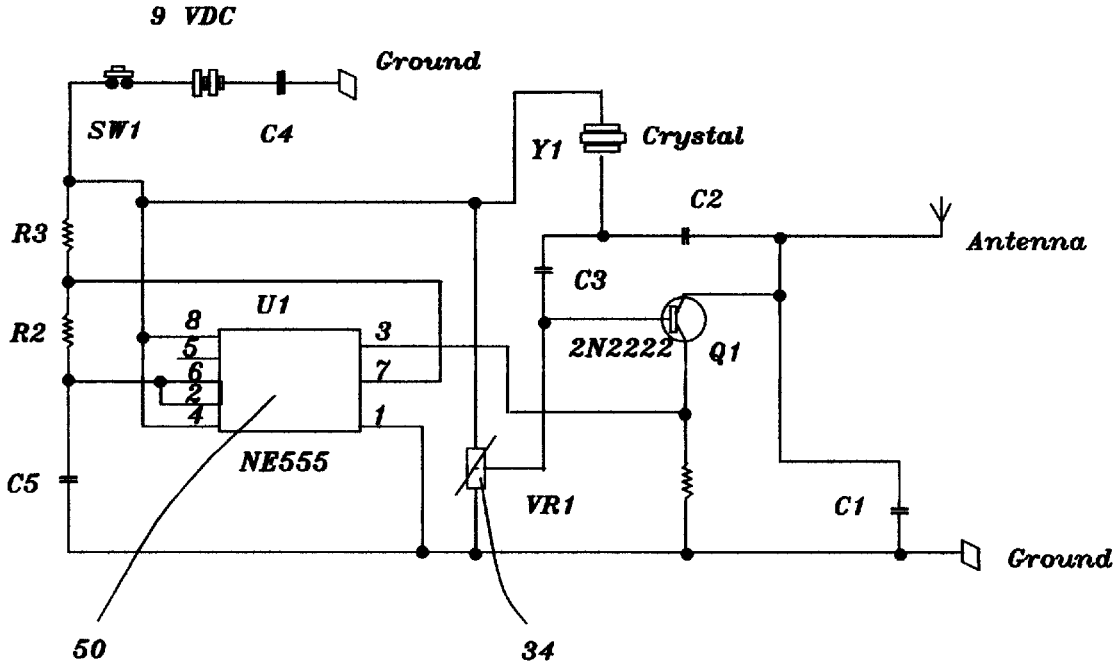
FIG. 6 is a circuit diagram showing details of the microprocessor for the apparatus shown in FIG. 1.

FIG. 6 is a circuit diagram showing details of a further microprocessor 50 of a remote receiver disposed within a house remote from the restricted area 12. As shown in FIG. 6, the further microprocessor 50 is associated with a variable resistor 34.

Moreover, the first mirror 18 is a plane mirror, the first mirror 18 being set angularly relative to the beam 16. The second mirror 20 is also a plane mirror which is disposed angularly relative to the first mirror 18. The first and second mirrors 18 and 20 respectively are spaced relative to each other so that the beam 16 travelling between the mirrors 18 and 20 can travel a distance of 100 yards or more as shown in FIG. 1. The distance travelled by the beam is a sum of a first distance D1 from the generator 14 to the first mirror 18, a second distance D2 from the first mirror 18 to the mirror 19, a third distance D3 from the mirror 19 to the second mirror 20 and a fourth distance D4 from the second mirror 20 to the collector 22.

As shown particularly in FIG. 2, the collector 22 includes a collecting lens 36 for collecting the beam 16 and an electronic circuit generally designated 38 for generating an electric signal in response to the beam 16 received by the collecting lens 36. A transmitter generally designated 40 is used for transmitting an electric signal from the microprocessor 24 when the beam 16 is broken. More specifically, the transmitter 40 is a radio transmitter for transmitting a R.F. wave from the microprocessor 24, the microprocessor 24 being disposed within a housing 41 together with the collector 22 as shown in FIG. 5.

Preferably, the apparatus 10 is used as a security fence placed around a swimming pool 42, as shown in Fig. 1, to provide a warning if a child 11 enters a pool area 12 which would present a potentially life threatening situation for the child 11 if the child 11 were to enter into the pool 42.

Figure 7:
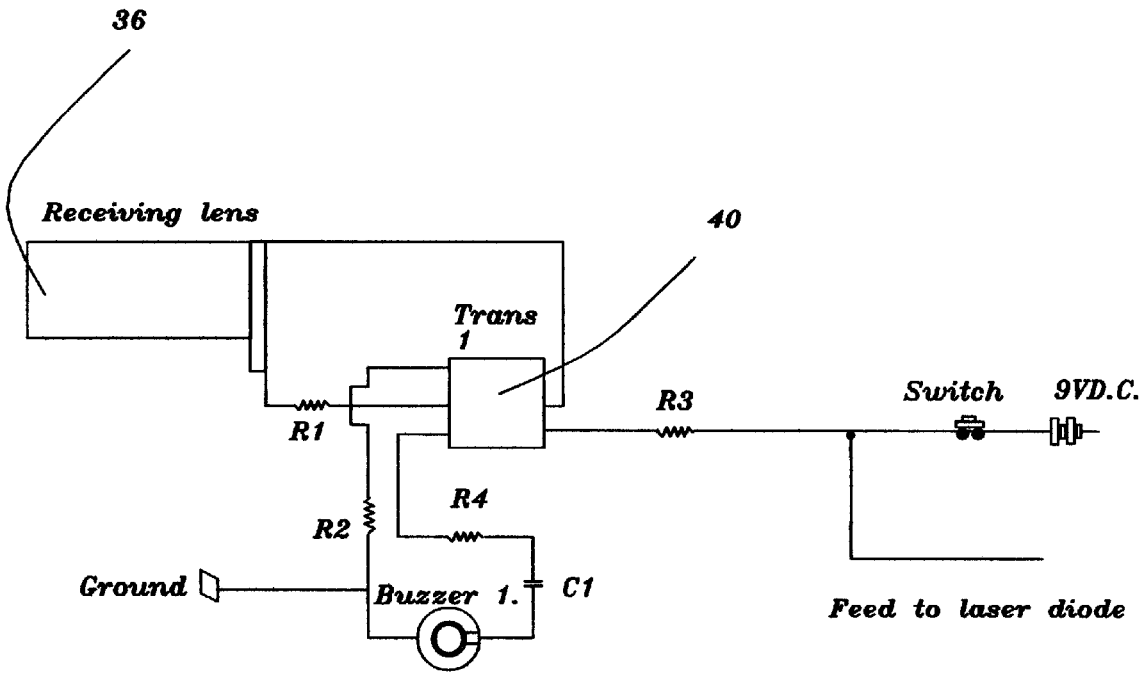
FIG. 7 is a power up schematic circuit diagram showing details of the collecting lens shown in FIG. 1.

FIG. 7 is a circuit diagram showing the collecting lens 36 and the transmitter 40.

Figure 8:
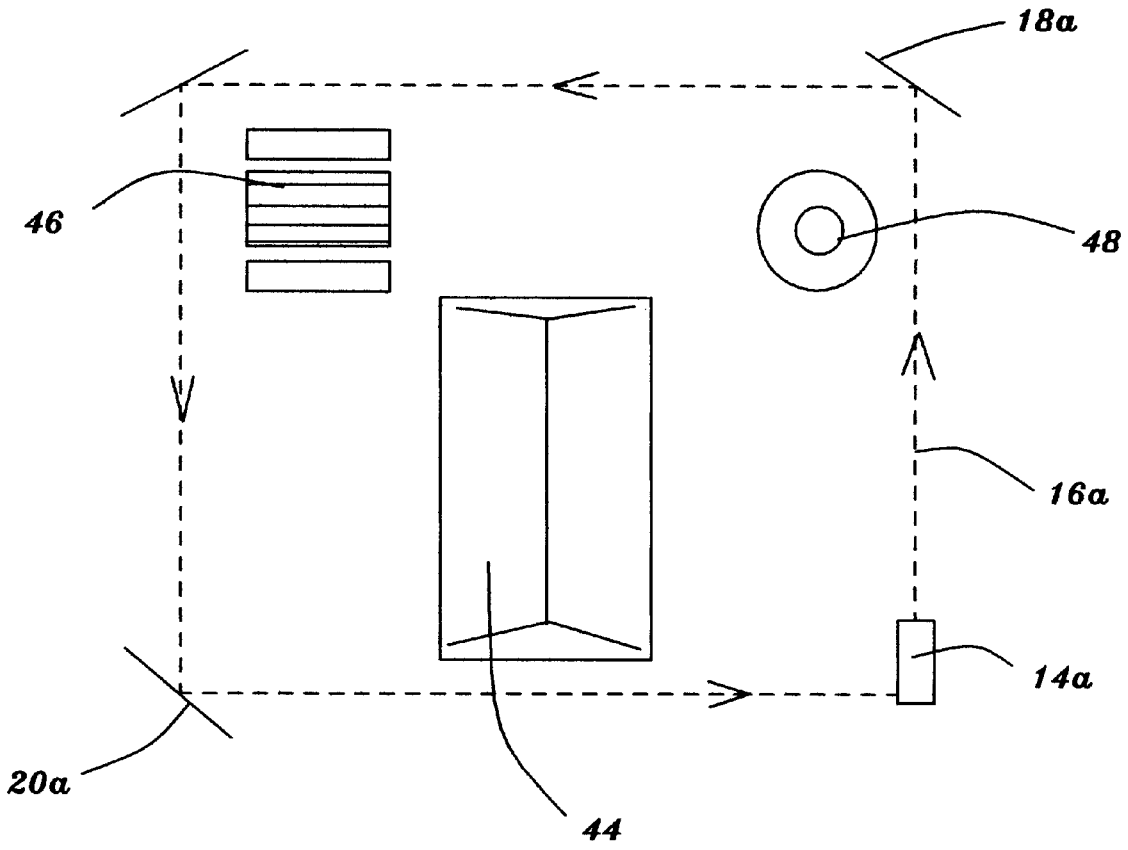
FIG. 8 is a top plan view of an alternative application of the apparatus according to the present invention.

FIG. 8 is a top plan view of an alternative application of the apparatus according to the present invention. As shown in FIG. 8, the apparatus 10*a* is also used to provide a fence around a camp site or the like including a picnic hut 44, table 46 and tree 48. In other respects, the apparatus 10*a* is identical to that shown in FIG. 1 and includes a generator 14*a*, a beam 16*a* and mirrors 18*a* and 20*a*.

In operation of the apparatus as shown in FIG. 1, when an intruder such as a child 11 attempts to enter a pool 42 in a restricted area 12, the beam 16 is broken so that the microprocessor 24 generates and permits the transmission of a warning signal that would alert the parents disposed remote from the restricted area about the potential life threatening situation.

What is claimed is:

1. A laser security fence apparatus for providing a warning signal in response to an intrusion by an intruder of a restricted area, said apparatus comprising:

a laser generator for generating a laser beam;

a first mirror aligned with said laser beam for reflecting said beam;

a second mirror aligned with said first mirror for reflecting said beam reflected by said first mirror;

a collector aligned with said second mirror for collecting said beam reflected by said second mirror;

a microprocessor associated with said collector and said generator for sensing when said beam is broken by the intruder so that said beam is not received by said collector;

an alarm connected to said microprocessor for actuation by said microprocessor when said microprocessor senses that said beam is broken so that said alarm provides the warning signal;

said collector including:

a collecting lens for collecting said beam;

an electronic circuit for generating an electric signal in response to said beam received by said collecting lens;

a transmitter for transmitting said electric signal from said microprocessor;

said transmitter being a radio transmitter for transmitting a R.F. wave from said microprocessor, said microprocessor being disposed in a vicinity of said collector;

a remote receiver for receiving said R.F. wave from said transmitter, said alarm being disposed within said remote receiver;

said laser generator including:

a 9 volt D.C. source of electrical energy;

a laser diode light;

a focal lens for focusing said laser beam;

said focal lens including:

a capacitor for adjusting a sensitivity and intensity of said beam;

said capacitor being a variable capacitor;

said first mirror being a plane mirror, said first mirror being set angularly relative to said beam;

said second mirror being a plane mirror, which is disposed angularly relative to said first mirror;

said first and second mirrors being spaced relative to each other so that said beam travelling between said mirrors travels a distance of over 100 yards;

said transmitter being a radio transmitter for transmitting a R.F. wave from said microprocessor, said microprocessor being disposed in a vicinity of said collector;

said apparatus being a security fence around a swimming pool to provide a warning if a child enters a pool area which would present a potentially life threatening situation for the child if the child were to enter into the pool; and said alarm including:

a delay device which when actuated, permits an operator to pass without setting off said alarm.

* * * * *